United States Patent [19]

Sasse

[11] Patent Number: 4,988,107

[45] Date of Patent: Jan. 29, 1991

[54] GOLF PUTER INCLUDING SIGHT BAR

[76] Inventor: Howard A. Sasse, 2101 Sandhills Blvd., Southern Pines, N.C. 28387

[21] Appl. No.: 460,390

[22] Filed: Jan. 3, 1990

[51] Int. Cl.[5] ..... A63B 69/36

[52] U.S. Cl. ..... 273/183 D; 273/164

[58] Field of Search ..... 273/183 D, 164, 163 R, 273/163 A, 194 B, 194 A, 194 R, 186 A, 186 C; 434/252; D21/219, 217, 218

[56] References Cited

U.S. PATENT DOCUMENTS

| | | | |
|---|---|---|---|
| 3,876,211 | 4/1975 | Caligiuri | 273/164 |
| 3,880,430 | 4/1975 | McCabe | 273/183 D |
| 4,367,877 | 1/1983 | Gibson et al. | 273/164 |
| 4,629,193 | 12/1986 | Pierman | 273/164 |
| 4,809,981 | 3/1989 | Doran | 273/164 |
| 4,919,424 | 4/1990 | Fukumochi et al. | 273/183 D |

*Primary Examiner*—George J. Marlo
*Attorney, Agent, or Firm*—Donald C. Studley

[57] ABSTRACT

The present putter is useful in aligning the striking surface of a putter, a golf ball, and the target. The putter is comprised of a shaft member having a clubhead at the lower end. The top surface of the clubhead has an indicating device consisting of a straight line marking or stripe located along the front top edge. A slanted sight bar is positioned above and perpendicular to the clubhead. The slight bar extends forward of the striking surface of the clubhead and backward beyond the rear of the clubhead. The top surface of the sight bar slants from the back portion downward toward the forward portion. The top portion of the sight bar has a longitudinal straight line indicating device thereon positioned perpendicular tothe indicating device on the clubhead. In a putting stance the golfer sees a cross. The stem of the cross located on the sight bar is placed on line with the hole. The lateral extentions of the cross located on the clubhead indicate the angle of the striking face. The present arrangement enables the golfer to initially align the striking face, a ball, and the target while simultaneously enabling a putting aide to sight the initial alignment and the alignment during the putting stroke. The position and weight of the sight bar enables the golfer to maintain a substantially true pendulum swing during the putting stroke and follow-through.

6 Claims, 1 Drawing Sheet

GOLF PUTER INCLUDING SIGHT BAR

The present invention relates to an improved golf putter, and more in particular to a putter having a slanted sight bar positioned above and extending over the clubhead. There are indicating means provided, preferrably in the form of straight line markings, on both the top surface of the sight bar and on the top surface of the clubhead. Such arrangement provides the golfer with an easy means of initially aligning the striking surface of the putter, a golf ball, and a target, or hole, and also facilitates the maintenance of such alignment during the putting stroke. The arrangement also provides a sighting means for a teacher or helper to independently determine the initial alignment and the alignment during the putting stroke.

It is important when putting, that is, driving the ball a short distance across a green into a hole, or cup, that the striking portion of the putter be maintained substantially perpendicular to the direction in which the player desires the ball to travel. If the putter face is not angled to the desired direction, the path of the ball will be to the left or right of the desired path, and the player will need to take an additional stroke, or strokes, to place the ball in the hole. Since the total number of strokes taken during the game determines the score, and the lower the score the better, additional strokes taken during putting are highly undesireable to the golfer.

Bearing out the above truism, the prior art is replete with aids to assist the golfer in aligning his putter, the ball, and the hole. The following are selected as examples of the closest prior art to the present invention of which applicant is aware. U.S. No. 3,292,928, relates to an attachable rod positioned atop the putter head; U.S. No. 3,448,981 teaches putter having a offset head; U.S. No. 3,667,761 discloses a putter having an offset shaft and an aiming rod on the putter head; U.S. No. 4,227,694 teaches a putter having an offset shaft portion; U.S. No. 4,265,451 discloses a putter having a protuberance on the head; U.S. No. 4,411,429 relates to a putter having a shaft offset in two directions; U.S. No. 4,629,193 teaches a putter having a sighting means positioned at the junction of the shaft and head, and; U.S. No. 4,809,981 discloses a putter having offset head and a back-extending alignment rod.

SUMMARY OF THE INVENTION

The present putter is useful in aligning the striking surface of the putter, the ball, and the target, usually a hole, or cup. The putter is comprised of a shaft member having a clubhead positioned at the lower end. The top surface of the clubhead is substantially flat and has an indicating means thereon positioned contiguous to the front longitudinal top edge of the clubhead. The indicating means is preferably in the form of a straight line marking or stripe. The putter has a slanted sight bar positioned above the clubhead which extends forward of the striking surface of the clubhead and backward beyond the rear of the clubhead. The top surface of the sight bar slants from the back portion to the rear of the clubhead downward toward the forward portion to the front of the clubhead. The top portion of the sight bar has an indicating means thereon which consists of a straight line marking positioned perpendicular to the indicating means on the clubhead. In a putting stance the golfer sees a cross. The stem of the cross located on the sight bar is placed on line with the hole, with a portion of the sight bar centered over the ball. The lateral extentions of the cross located on the clubhead indicates the angle of the striking face. The position of the sight bar when the putter is used adds weight in front of the ball, thus, when the ball is impacted, it is both pulled and pushed on a straight targeted path. The present arrangement enables the golfer to initially align the striking face, a ball, and the target while also enabling a putting teacher or helper to simultaneously sight the initial alignment and the alignment during the putting stroke. The added weight of the sight bar positioned above the clubhead also enables the golfer to maintain a substantially true pendulum swing during the putting stroke and follow-through and develop a "feel" for well-aligned and stroked putt.

DRAWINGS AND DETAILED DESCRIPTION

The invention will now be described in greater detail and in preferred embodiments by reference to the accompanying drawings in which similar components have the similar reference numerals in each of the views.

Figure 1:
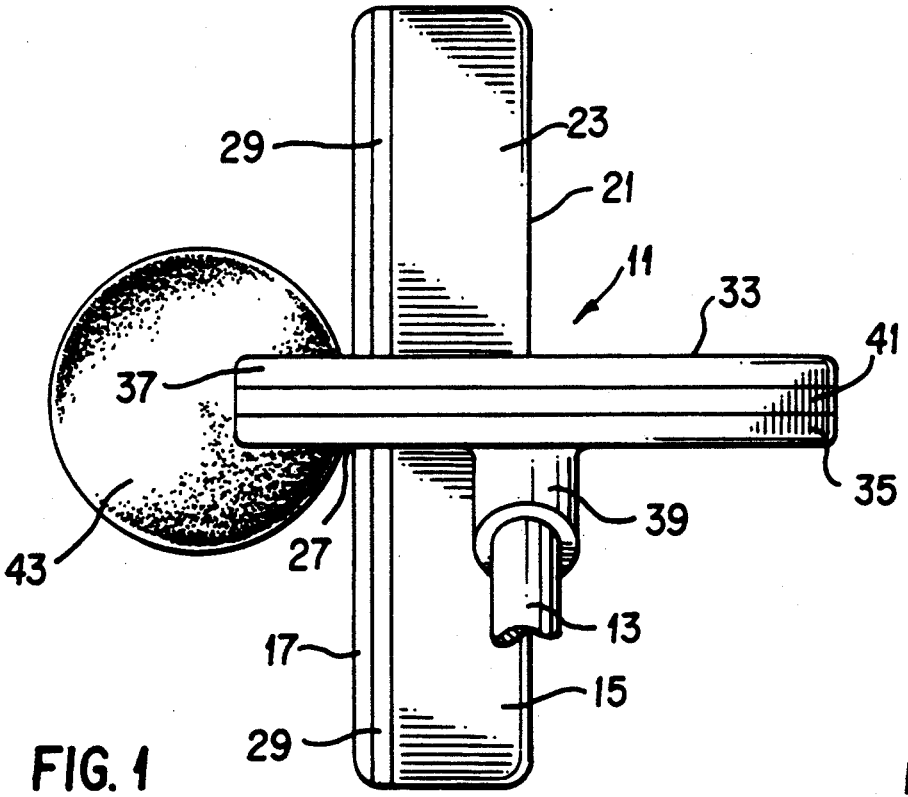
FIG. 1 is a top plan view of the golf putter showing the clubhead and a portion of the lower shaft.
Figure 2:
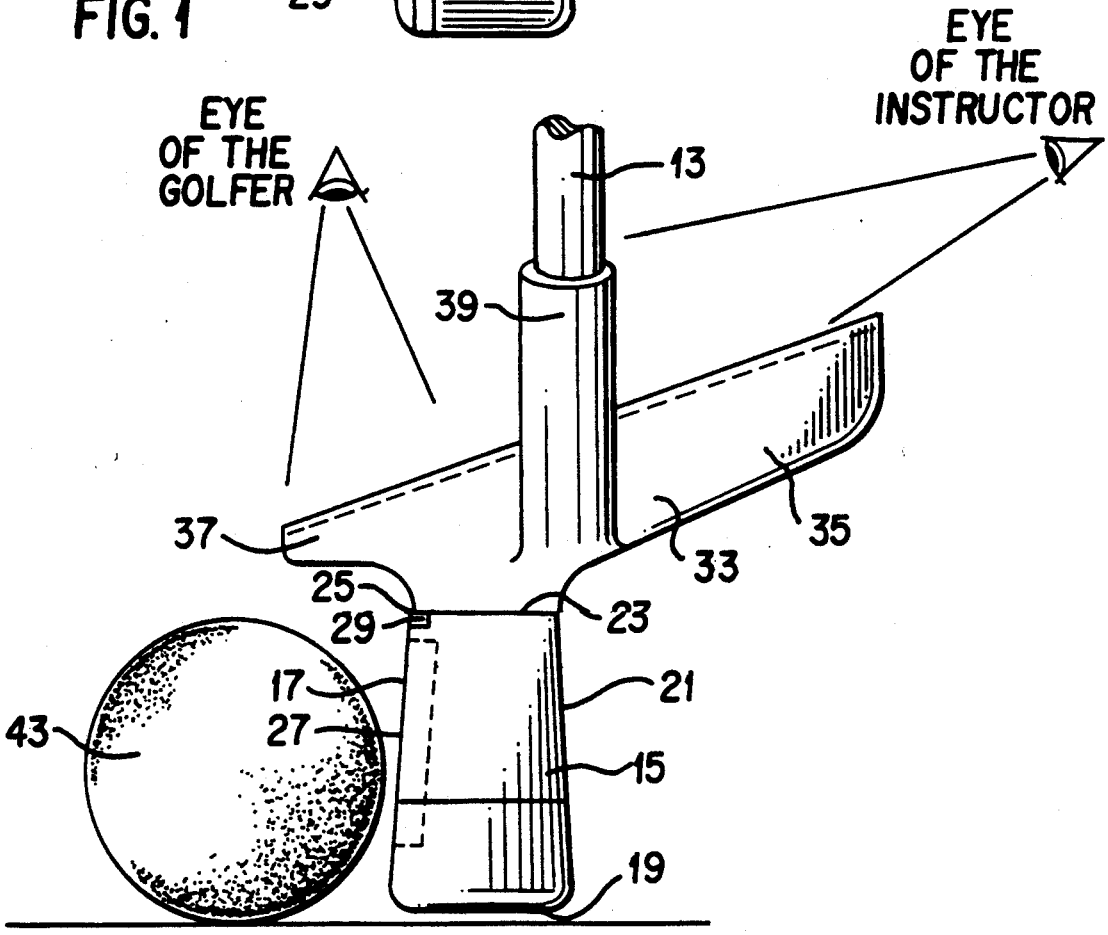
FIG. 2 is a side elevational view illustrating a preferred ignment arrangement of the clubhead, a ball, and a sight bar having an inclined top surface. This view also illustrates the views that both the user of the club and a putting instructor would have when positioned behind the user when the user is positioned in a putting stance.

Looking now at FIG. 1, golf putter, generally shown as 11, has a shaft member 13 and a clubhead 15. Shaft member 13 consists of an elongated, substantially axial, rod which is typically tapered toward the lower, or clubhead, end. Shaft member 13 has a grip portion positioned adjacent the upper end (not shown). Suitably shaft member 13 has a lie, that is, it is in a vertical plane which is disposed from horizontal plane of clubhead 15, at an an angle of at least 10 degrees and more preferably from about 15 to about 20 degrees to conform to USGA rules. Clubhead 15 has a front, substantially flat, striking surface, or face, 17, a sole portion 19, rear surface 21, and a substantially flat top surface 23. In the embodiment shown the putter has a rocker bottom, e. g., sole portion 19 has a compound curvature. It will be understood, however, that sole portion 19 may suitably be of other shapes, for example, rounded in a single direction or substantially flat. Striking surface 17 suitably has a "sweet spot", e. g., 27, usually centrally located thereon. It is particularly advantageous to strike a ball in the sweet spot area because of the weight and balance of the club. Striking face 17 is suitably inclined in an upward and rearward manner to provide a positive loft of between 2 and 4 degrees. Clubhead 15 has substantially straight front and rear edges, 25. Top surface 23 of clubhead 15 has an indicating means 29 on the forward portion contiguous to edge 25 consisting of a straight line marking, or stripe, 29. Although it is not a preferred enbodiment, the rear top edge of clubhead 15 may also have a similar indicating means. Preferrably the indicating means 29 extends substantially the entire longitudinal length of top surface 23. The indicating means may be placed on top surface 23 by painting or other means, for example, by stamping or embossing, by the use of an inset, or embedded, strip, or by means of a slot. Suitably the indicating means is colored to contrast with the color of the clubhead, the shaft and the golf green, generally useful colors are white, yellow, or blue.

Sight bar 33 is joined to and connects clubhead 15 and shaft 13. Sight bar 33 is comprised of an elongated bar having an inclined, or slanted, top surface. The top surface of sight bar 33 tapers from a rear portion 35 downward to a, front portion 37. The angle of taper preferrably varies from about 10 degrees to about 40 degrees. Angles of less than 10 degrees or greater than 40 degrees usually do not allow the teaching golfer, or putting instructor, to easily view the alignment of the club, ball and hole simultaneously with the putter, or student. Forward portion 37 of sight bar 33 extends above the clubhead and outward over striking surface 17 of clubhead 15. In a particularly useful embodiment prow 37 is centered directly above the sweet spot, 27, or the most favorable stiking area, of striking surface 17. Suitably, sight bar 33 has a shank portion, such as, 39 to facilitate receiving and securing therein the lower end of shaft 13. Sight bar 33 is positioned in a vertical plane perpendicular to the horizontal plane of top surface 23 of clubhead 15. Sight bar 33 has an indicating means, which is a primary aiming line, 41 centrally positioned on the top surface thereof which extends from rear portion 35 to the forward portion 37. Primary aiming line 41 may be painted or otherwise imprinted thereon as described in the foregoing in regard to the indicating means positioned on the top surface of clubhead 15. It is preferred that the primary aiming line 41 be of a slightly greater width than the width of indicating means 29 on clubhead 15.

When the golfer addresses a ball using the present putter, he sees the primary aiming line 41 atop sight bar 33, using this line he can easily center forward portion 37 over a ball, such as, 43. He then aligns the primary aiming, line 41 with the hole. If at this point the ball is hit squarely, it would proceed on a direct course toward the hole. However, it is at this point that many golfers fail initially align, or fail to maintain such alignment during the putting stroke, to obtain the required square hit. In the present case, and critical to the present invention, the golfer and his instructor, if present, both see, in addition to the primary aiming line 41, a lateral indicating means, e. g., stripe 29 on clubhead 15 which indicate the angle of the striking face 17. Thus, the golfer sees a cross. The stem of such cross is defined by the primary aiming line 41 and the lateral extentions are straight line marking 29 on clubhead 15.

As viewed by the golfer, the slope and movement of sight bar 37 with primary aiming line 41 provides a visual aiming means analogous to that used in the alignment of a billiard cue and ball.

It is to be noted that when the present putter is in use, forward portion 37 of sight bar 33 is positioned forward of the striking face of the clubhead. In accord, during the putting stroke the weight of forward portion 37 moves ahead of the striking face of the clubhead. In this manner the putting stroke is divided into both a pulling of the ball and a pushing of the ball which gives the golfer a substantially true pendulum swing. In such arrangement the ball tracks the pendulum path and the tendency of the golfer to twist or turn the clubhead during the putting stroke is minimized.

The present putter is a putting aid that has a two-fold purpose, first it is scientifically sound and improves the golfers confidence on the green by knowing that even if the putt is long or short, it will be on line, and second, a means is provided for the putting instructor positioned to the rear or to the side of the putter to simultaneously view the initial alignment, just as the putter sees it, and subsequently to view the alignment through the stroke and follow through.

While it is preferred that sight bar 33 be fabricated as a intergal part of clubhead 15, it will be understood that the sight bar may be fabricated as part of shaft member 13, or as a separate component. Although not a preferred embodiment, the entire putter may be fabricated in a single piece.

It will be apparent to those skilled in the art that the present invention is not limited to the specific details described above and shown in the accompanying drawings, and that various further modifications are possible in carrying out the features of the invention without departing from the spirit and scope of the appended claims.

What is claimed is:

1. A golf putter having a shaft member, a clubhead, and a sight bar, said putter comprising:

(a). a clubhead having a substantially flat front striking face, said clubhead having a top surface, said top surface having a substantially straight longitudinal front edge, an indicating means in the form of a straight line positioned contiguous to said front edge, (b). a sight bar joined to and connecting said clubhead and said shaft member, said sight bar having a forward portion and a rear portion, said sight bar having an inclined top surface tapering downward from said rear portion to said front portion, the said forward portion of said sight bar positioned above said clubhead and extending forward of said striking face, said top surface of said sight bar having a primary aiming means thereon comprised of a straight line marking centrally positioned thereon, (c). when viewed by a golfer in a putting stance, he sees a cross, the stem of the cross being said primary aiming means on said sight bar neck member and the lateral extensions of the cross being the said indicating means on said clubhead, and (d). said arrangement facilitating an easy alignment by the golfer in a putting stance of the striking face of the clubhead with a ball and a target, and the maintenance of such alignment during the putting stroke, while simultaneously providing a means for a putting instructor positioned aside or behind the golfer to view the same alignment.

2. The putter of claim 1 wherein the primary aiming means on said sight bar is a wider straight line marking that the the indicating means on said clubhead.

3. The putter of claim 1 wherein the straight line markings that make up the primary aiming means on said sight bar and the indicating means on said clubhead are white, yellow or blue.

4. The putter of claim 1 wherein the straight line markings are in the form of slots.

5. The putter of claim 1 wherein said sight bar is an intergal part of the clubhead.

6. The putter of claim 1 wherein the sight bar tapers downward from said rear portion toward said forward portion at an angle of between about 10 and about 40 degrees.

* * * * *